United States Patent [19]

Tanson

[11] 4,419,127

[45] Dec. 6, 1983

[54] METALLOTHERMAL PROCESS FOR REDUCING METAL OXIDES

[75] Inventor: Aloyse Tanson, Luxembourg, Luxembourg

[73] Assignee: Continental Alloys A.A., Dommeldange, Luxembourg

[21] Appl. No.: 377,034

[22] Filed: May 11, 1982

[30] Foreign Application Priority Data

May 13, 1981 [LU] Luxembourg ..... 83361

[51] Int. Cl.[3] ..... C22B 4/00

[52] U.S. Cl. ..... 75/10 R; 75/11; 75/27

[58] Field of Search ..... 75/10–12, 75/27, 24, 44 S

[56] References Cited

U.S. PATENT DOCUMENTS 4,083,715 4/1978 Langhammer ..... 75/44 S

*Primary Examiner*—P. D. Rosenberg

*Attorney, Agent, or Firm*—Karl F. Ross; Herbert Dubno

[57] ABSTRACT

In order to produce metals or ferroalloys, a mixture of metal oxides, reducing agents and possibly iron is ignited, to produce a metal melt as well as a slag melt. After the burn-out the still liquid slag is reacted with a suitable means, preferably calcium fluoride to increase its electrical conductivity. The liquid slag is then heated and simultaneously ignited by alternating current applied to water-cooled graphite electrodes. Over an emperically determined time span, the melt is reacted with an additional reducing agent, until substantially complete transformation of the metal oxide remaining in the slag and migration of the resulting metal into the metal phase.

9 Claims, 3 Drawing Figures

METALLOTHERMAL PROCESS FOR REDUCING METAL OXIDES

FIELD OF THE INVENTION

The present invention relates to a process for increasing the conversion in the field of thermometallurgical processes in which mixtures of metals, metal oxides and reducing agents are ignited whereby metal melts and slag melts are produced.

BACKGROUND OF THE INVENTION

The thermometallurgical processes, such as especially the thermoalumino process and the thermosilico process for reduction of metal oxides to metals, have been known for a long time. Thus, for example, chromium metal and alloys such as ferrovanadium (FeV) and ferroniobium (FeNb), are produced aluminothermally and ferromolybdenum (FeMo) is produced silicothermally. Ferrotungsten (FeW) is produced aluminosilicothermally.

Such processes run generally discontinuously and a mixture prepared of metal oxide, reducing agent (Al,Si) and possibly even metals (Fe) is formed in a fixed or transportable reaction vessel and ignited. For this purpose one generally uses chemical or electrical starters.

Once ignition is initiated, the desired reaction occurs vehemently and at high velocity; inclusions are practically impossible since the reaction vessel can be closed with an evacuation hood which carries the hot waste gases to a gas-cleaning station.

After 2 to 4 minutes the metal phase separates from the slag phase and one can permit the contents of the reaction vessel to cool and solidify. Only limited conversions or yields can be obtained by these techniques.

OBJECT OF THE INVENTION

It is the principal object of the present invention to provide an improved method of producing a metal from an oxide thereof, whereby disadvantages of earlier approaches are obviated.

It is also an object of this invention to improve the conversion of metal oxides to metal utilizing the thermometallurgical or metallo-thermal processes previously described, with respect to the proportion of the metal oxide which can be transformed into the elemental metal.

SUMMARY OF THE INVENTION

I have found, quite surprisingly, that the metallo-thermal conversion of metallic oxide to elemental metal utilizing aluminum and silicon as reducing agents can be markedly improved and hence that the process for producing such metals from metal oxides can be correspondingly improved if a further reducing reaction is induced in the molten slag formed by the metallothermal reaction.

According to this invention, therefore, the process is carried out in two distinct stages:

In a first stage, the metal oxide to be transformed into the elemental metal is combined with a reducing agent selected from the group which consists of aluminum and silicon or mixtures or alloys thereof, or of other metals whose oxide can ultimately pass into a slag, the mixture, if desired, also containing other elemental metal, especially iron, and being ignited so that a metallothermic reaction is sustained in which the desired elemental metal is liberated from its oxide and is produced in a molten state covered by a slag, also in a liquid state, in which the aluminum or silicon oxides are to be found.

In the second stage of the reaction, i.e. following completion of the first stage and hence burn up of the reaction system of the first stage and, while the slag is at least partly fluid, a conductivity promoting agent is added to the slag and the slag is electrically heated and agitated to induce a further reaction between any metal oxide in the slag or the melt which is likewise heated with reducing agents which can be added during this second phase.

The second phase reaction is continued until all of the metal oxide remaining after the first stage reaction is completely reacted, i.e. the metal thereof migrates into the molten phase and the oxides of aluminum or silicon thereby produced migrate into the slag phase.

The process of the invention thus provides a mixture of metal oxides and reducing agents and even possibly iron such that a metal melt and a slag melt are produced. From burn up, the still liquid slag is reacted with suitable means for increasing its electrical conductivity, preferably calcium fluoride. The melt is then electrothermally heated and is treated for an empirically determined period with additional reducing agents until approximately all of the metal oxide found to remain in the slag is reacted and the resulting metal has migrated to the metal phase.

The basis underlying the development of the process of the invention derives from the fact that it is not rational to attempt to influence the conversion in a metallo-thermo process during the process phase while the usual reactions occur. It is far more effective to allow this reaction to conclude and the resulting product to be subjected to a specific treatment at a time in which it can be influenced. This point in time is substantially the point when both the metal and the oxide phases are in liquid states. The specific treatment can consist, in accordance with the invention, of an after-reduction of the slag melt by heating and agitation.

As will be apparent, the conductivity promoting agent is a material which is compatible with the slag phase and thus has a low specific gravity so that it will not appear in the molten metal phase but rather will be confined to the slag phase. Such a conductivity-promoting material is calcium fluoride ($CaF_2$).

Furthermore, the electrical heating and agitation during the second stage of the reaction is best carried out by techniques which have been found to be successful in electro-slag-remelting, i.e. by the conduction of a low-voltage high-current AC through the slag between at least one pair of water cooled graphite loads immersed in the slag.

Two phase current (65 volts/12,500 amperes) is preferred.

BRIEF DESCRIPTION OF THE DRAWING

The individual process steps are amplified in connection with the description of the drawing in which.

SPECIFIC DESCRIPTION

Figure 1:
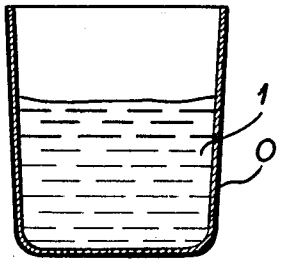

FIG. 1 shows a reaction vessel O which can be displaced on rails not shown. The vessel (ladle) O is charged with a mixture 1 of metal oxide such as, for example, $Nb_2O_5$, iron in the form of powder or fine scrap and aluminum powder. The mixture 1 can have a weight greater than 3 tons.

Figure 3:
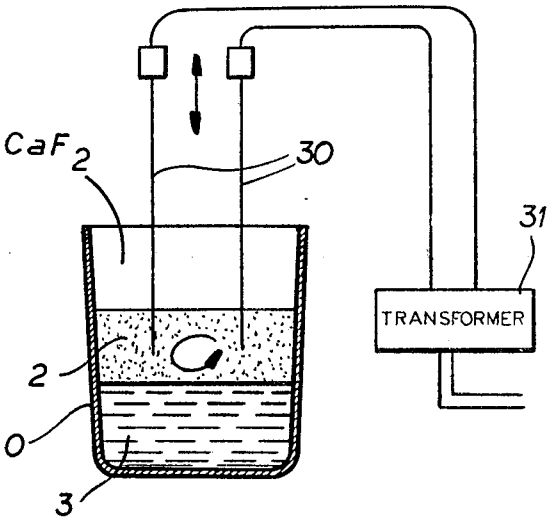
FIGS. 1, 2 and 3 are schematical illustrations of the individual process phases.
Figure 2:
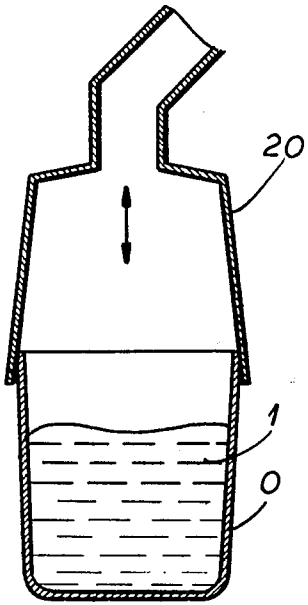

The reaction vessel O is passed beneath a raisable and lowerable safety and evacuation hood 2. The mixture, as shown in FIG. 2, is ignited. The contents of the vessel react violently, the hood 2 is lowered; after 2 to 4 minutes the hood is raised and the hot vessel rapidly shifted to the next process stage shown in FIG. 3.

Meanwhile, the reaction terminates although the slag 2 and the metal phase 3 remain largely in liquid form. The slag 2 is reacted with calcium fluoride $CaF_2$ and thereby has its conductivity increased. Then one or more electrode pairs 3 are immersed in the slag and are connected with a power transformer 31. The latter supplies a 2-phase current of about 65 V and 12,500 amperes. The resulting process is a continuous electrothermal heating of the slag as well as the metal bath by the known electroslag mode whereby a characteristic movement is generated within the slag.

Indeed, magnetic fields spread from the electrodes and induce currents in the conductive slag which, by analogy with the agitation technique common in continuous casting are effective for agitation.

For the practical performance of the method of the invention, a process control is of course necessary. This is provided, in accordance with the invention, by taking slag samples during the after-reduction of the slag with a reducing agent and determining the content of the nontransformed reducing agent and metal oxide. As a matter of fact the treatment of the invention of metal oxide with metallic aluminum or silicon must be carried out with special care so that, on the one hand, there is always sufficient reducing agent to maintain the after-reduction. At the same time the use of excesses should be avoided since the high uptake of aluminum or silicon in the metal or ferroalloy to be produced is not desirable.

In any case it is preferred to maintain the fixed timing of the slag sampling and the quantities of the materials fed so that empirical values can be collected which allow the process to be conducted without analytical control and the feed of the reducing agent controlled purely by the timing.

SPECIFIC EXAMPLE

A batch is made up of about 340 kg. iron, about 800 kg. niobium pentoxide ($Nb_2O_5$) and 135 kg. aluminum, all previously ground to a particle size in the millimeter range and intimately blended.

The mixture is ignited from the top with a gas torch and is permitted to burn out in a graphite crucible, leaving a molten metal phase covered by an $Al_2O_3$-containing slag phase.

While the slag phase is still molten and after burnout, utilizing the sampling system described from a previous batch, additional aluminum is supplied while the slag is heated by passing an electric current of about 12,500 amperes at 65 volts between a pair of water-cooled graphite electrodes immersed in the slag.

When the reaction ends, the slag is poured off and the metal phase is solidified, approximately 890 kg. of FeNb are recovered.

The advantages of the process of the invention can be summarized as follows.

When, for example ferroniobium is to be produced from $Nb_2O_5$, iron and aluminum, about 6% niobium must be provided in the slag according to the state of the art. The process of the invention permits reduction of the Nb in the slag to practically zero. This means that a relatively high aluminum concentration must be expected in the end product. If one considers the drastic after-reduction, the niobium contents in the slag can be reduced to 1.5 to 2% without a critical uptake of aluminum in the end product detrimental to the quality. Thus, according to the invention, niobium conversions about 98% can be reached. The after-reduction according to the invention lasts in the present case only 20 to 35 minutes.

Not unimportant is the fact that the process of the invention allows the high conversions to be reached using "top firing" whereby the starting mixture can be ignited from above downwardly.

I claim:

1. A method of producing metal from a metal oxide which comprises the steps of:

(a) forming an ignitable autogenously reactive mixture containing said metal oxide and at least one metallic reducing agent for said metal oxide, igniting said mixture from the top with an ignition source to initiate a reaction within the mixture, and then permitting the reaction within said mixture to proceed autogenously to produce a molten metal phase surmounted by a slag phase;

(b) while said slag phase is retained and remains liquid but after burnout of the reaction in step (a), introducing at least one pair of electrodes into said slag phase and passing an alternating current through said slag phase between said electrodes to heat said slag phase and induce further reaction of residual metal oxide therein whereby metal from said metal oxide migrates to said metal phase; and (c) adding a required amount of metallic reducing agent to said slag phase at an empirically determined rate during the heating in step (b).

2. The method defined in claim 1 wherein said slag phase is heated in step (b) by passing a two-phase alternating current through said slag phase at a voltage of about 65 volts and a current of about 12,500 amperes.

3. The method defined in claim 1 wherein said electrodes are water cooled graphite electrodes.

4. The method defined in claim 1, claim 2, claim 3 or claim 6 further comprising the step of taking slag samples during the treatment of said slag phase with added reducing agent at fixed sampling intervals and increasing or diminishing the rate of addition of said reducing agent depending upon the content of unreacted reducing agent and metal oxide in said metal oxide.

5. The process defined in claim 4 wherein said reducing agent is selected from the group which consists of aluminum, silicon and mixtures thereof.

6. A method of producing metal from a metal oxide which comprises the steps of:

(a) forming an ignitable autogenously reactive mixture containing said metal oxide and at least one metallic reducing agent for said metal oxide, igniting said mixture from the top with an ignition source to initiate a reaction within the mixture, and then permitting the reaction within said mixture to proceed autogenously to produce a molten metal phase surmounted by a slag phase;

(b) after burnout of the reaction of step (a) while retaining said slag phase in liquid from, adding a conductivity enhancing agent thereto;

(c) thereafter introducing at least one pair of electrodes into the slag phase in a liquid state and containing said agent and passing an alternating current through said slag phase between said electrodes to heat said slag phase and induce further reaction of residual metal oxide therein whereby metal from said metal oxide migrates to said metal phase; and (d) adding a required amount metallic reducing agent to said slag phase at an empirically determined rate during the heating in step (c).

7. The method defined in claim 6 wherein said slag phase is heated in step (c) by passing a two-phase alternating current through said slag phase at a voltage of about 65 volts and a current of about 12,500 amperes.

8. The method defined in claim 6 wherein said electrodes are water cooled graphite electrodes.

9. The method defined in claim 6, claim 7 or claim 8 wherein said conductivity-enhancing agent is calcium fluoride.

* * * * *